US007509712B2

(12) United States Patent
Sima

(10) Patent No.: US 7,509,712 B2
(45) Date of Patent: Mar. 31, 2009

(54) DEVICE FOR THE CONNECTION OF A BAND TO A FURTHER PART

(75) Inventor: Wolfgang Sima, Keutschach (AT)

(73) Assignee: Hirsch Armbander GmbH, Klagenfurt (AT)

( * ) Notice: Subject to any disclaimer, the term of this patent is extended or adjusted under 35 U.S.C. 154(b) by 16 days.

(21) Appl. No.: 11/526,009

(22) Filed: Sep. 25, 2006

(65) Prior Publication Data

US 2007/0067967 A1 Mar. 29, 2007

(30) Foreign Application Priority Data

Sep. 26, 2005 (AT) ..... GM 648/2005

(51) Int. Cl.
*A44C 5/14* (2006.01)

(52) U.S. Cl. ..... 24/265 WS

(58) Field of Classification Search ..... 24/265 WS, 24/265 R, 653, 644, 652; 368/282
See application file for complete search history.

(56) References Cited

U.S. PATENT DOCUMENTS 2,820,275 A * 1/1958 Lancaster ..... 24/265 WS
3,897,963 A * 8/1975 Seiffert et al. ..... 280/802
3,908,243 A 9/1975 Lou et al.
4,231,502 A * 11/1980 Meyerson ..... 224/177
4,605,312 A * 8/1986 Sellier ..... 368/282
6,481,069 B1 11/2002 Cheng

FOREIGN PATENT DOCUMENTS

JP 2002-65322 3/2002

* cited by examiner

*Primary Examiner*—Robert J Sandy
(74) *Attorney, Agent, or Firm*—Dickstein Shapiro LLP

(57) ABSTRACT

A device for the connection of a band to a further part. The device has a casing (3) fixable to the band, forming a unit with the band and receiving a locking element (1). The locking element (1) in the casing (3) is mounted about an axis (12) so as to be pivotable from a retaining position into a release position and back. The axis (12) is oriented transversely to the longitudinal extension of the band and in parallel to the band plane. The casing (3) is provided, at the front side, with an opening (9) for inserting a retaining clip arranged at the further part. The retaining clip can be brought into a form-fitting connection with the locking element (1) which is in the retaining position.

12 Claims, 4 Drawing Sheets

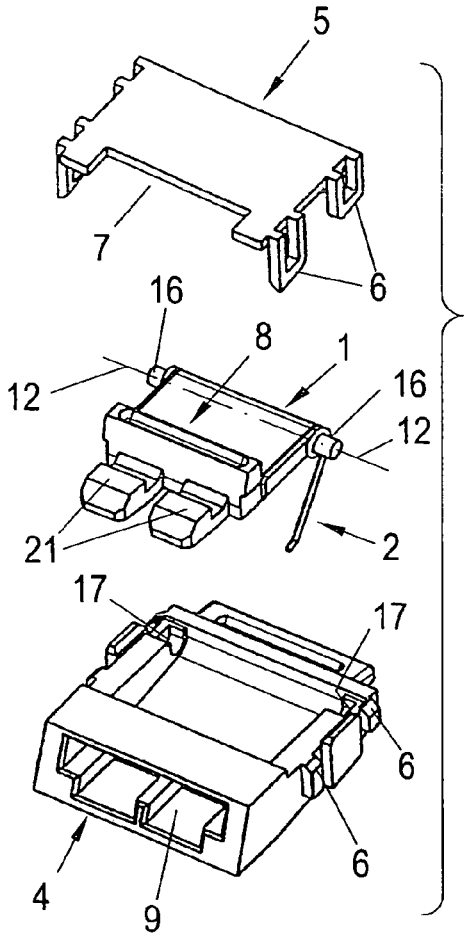
Fig. 1
Fig. 2
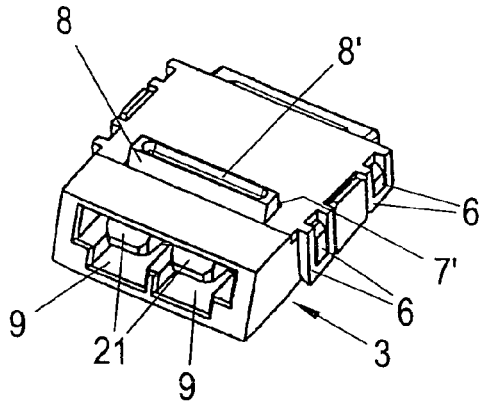
Fig. 5
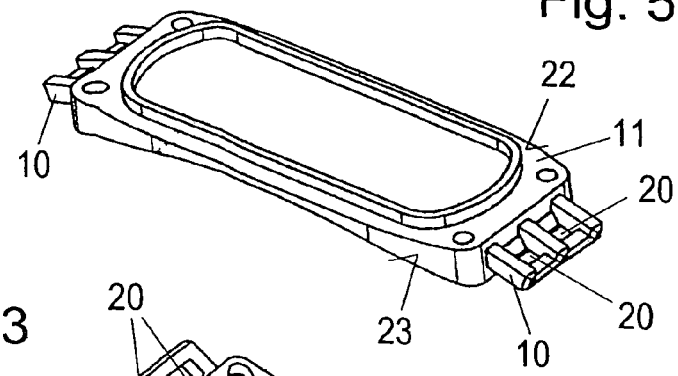
Fig. 3
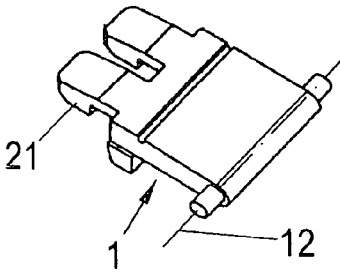
Fig. 6
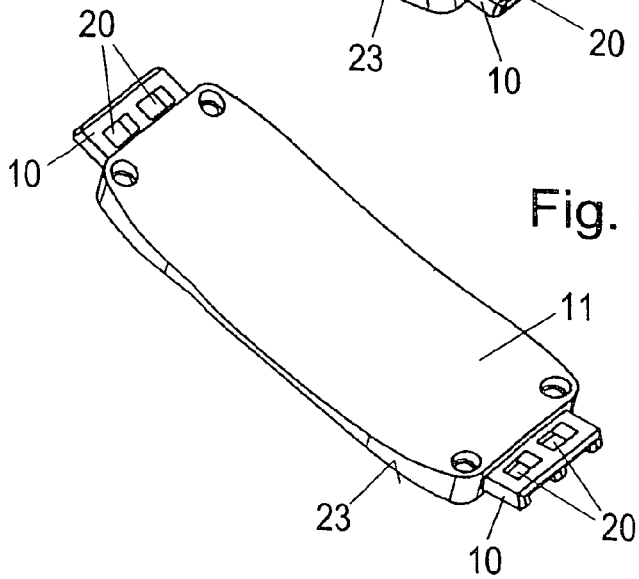
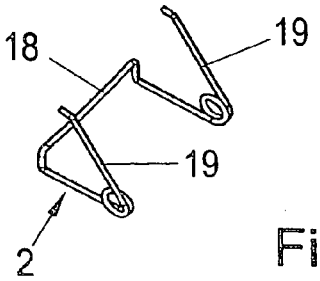
Fig. 4

DEVICE FOR THE CONNECTION OF A BAND TO A FURTHER PART

BACKGROUND OF THE INVENTION

The invention relates to a device for the connection of a band to a further part, in particular a wristband to a further part such as a watchband to a watch casing.

A device for connecting a watchband to a further part, which, in turn, is articulated to a watch casing, is known from U.S. Pat. No. 3,908,243 A. The further part is thereby designed as a casing in which a locking element is displaceable in the longitudinal direction of the band or is pivotably mounted about an axis oriented vertically to the plane of the band. Furthermore, the further part has an opening into which a hook element of a retaining part articulated to the band is insertable. Upon inserting the hook of the retaining part into the recess of the further part, a form-fitting connection is achieved between the hook part and the further part, which form-fitting connection is securable with the aid of the locking element by displacing the locking element relative to the hook part or twisting the same, respectively, whereby the hook part is overlapped. For detaching the watchband from the further part arranged at the watch casing, the locking element is provided with actuating elements for pushing back and twisting, respectively.

This design is complex and not easily operable, particularly since the locking element is difficult to handle when it is operated, especially in case of soilings, as a result of the surfaces sliding on each other. Furthermore, this known device is complicated to assemble and thus expensive. During assembly, the two parts have to be brought into a misaligned position, have to be stuck together and subsequently have to be assembled vertically to the direction of sticking. The aligned position is achieved only after the hook element has locked into place. This results in a way of handling which is not quite easy and may cause faulty couplings and also damage to any of the parts.

SUMMARY OF THE INVENTION

The invention aims at avoiding said disadvantages and difficulties and has as its object to provide a device of the initially described kind which is easy to operate so that, for example, a watch casing can easily and quickly be connected to different wristbands, which, for example, are colour coordinated with the clothes, even by persons not skilled in the art of watchmaking. Furthermore, the device is supposed to be robust and fully functional also if soiled. In addition, it should also be easy to manufacture and assemble.

According to the invention, this object is achieved by a combination of the following features:

- a casing fixable to the band, forming a unit with the band and receiving a locking element,
- wherein the locking element in the casing is mounted about an axis so as to be pivotable from a retaining position into a release position and back,
- the axis is oriented transversely to the longitudinal extension of the band and in parallel to the band plane,
- and wherein the casing is provided, at the front side, with an opening for inserting a retaining clip arranged at the further part, which retaining clip can be brought into a form-fitting connection with the locking element which is in the retaining position.

A compact design, which is also optically very appealing, is characterized in that the locking element ends in the region of the front side of the casing without projecting from the casing both in the retaining position and in the release position.

Particularly easy handling is ensured if the locking element is provided with an actuating part projecting through an opening disposed on one side of the casing, optionally projecting beyond the exterior thereof, with the actuating part preferably being provided with an actuating notch at its end projecting through the opening of the casing.

Great security against unintentional opening is provided by a spring element pushing the locking element into the retaining position.

The device is particularly easy to assemble if the casing has a two-part design and if those two parts can be fixed to each other preferably by means of a snap connection.

A connection between the band and the further part which is stationary in itself is provided if the retaining clips of the further part are rigidly arranged on the same, wherein the front side of the casing is preferably adapted to the rigid part provided with the retaining clip if a form-fitting connection is provided between the locking element and the retaining clip, whereby a connection almost free from play is formed.

A simple design is characterized in that the locking element comprises a hook which is insertable into a recess of the retaining clip, which recess is shaped so as to correspond to the hook, whereby, to achieve better support, preferably two hooks arranged side by side are provided and the retaining clip is provided with two recesses corresponding thereto.

Suitably, the casing is glued to a wristband, in particular to a watchband, or is cast integral with the same.

For connecting a band to a watch casing, the retaining clips are formed integral with the watch casing and, with the watchband being attached, are covered by the same or by the casing, respectively, preferably toward the top side and toward the side faces of the watch casing.

BRIEF DESCRIPTION OF THE DRAWINGS

Below, the invention is illustrated in further detail as an application for connecting a watch casing to a watchband by way of an exemplary embodiment illustrated in the drawing, wherein FIG. 1 shows an exploded diagonal view of parts of the device, FIG. 2 illustrates said parts in the assembled state, and FIGS. 3 and 4 illustrate said parts separately.

FIG. 5 shows a watch casing in diagonal section seen from above, and

FIG. 6 shows the same in diagonal section seen from below.

DETAIL DESCRIPTION OF THE PREFERRED EMBODIMENT

Figure 7:
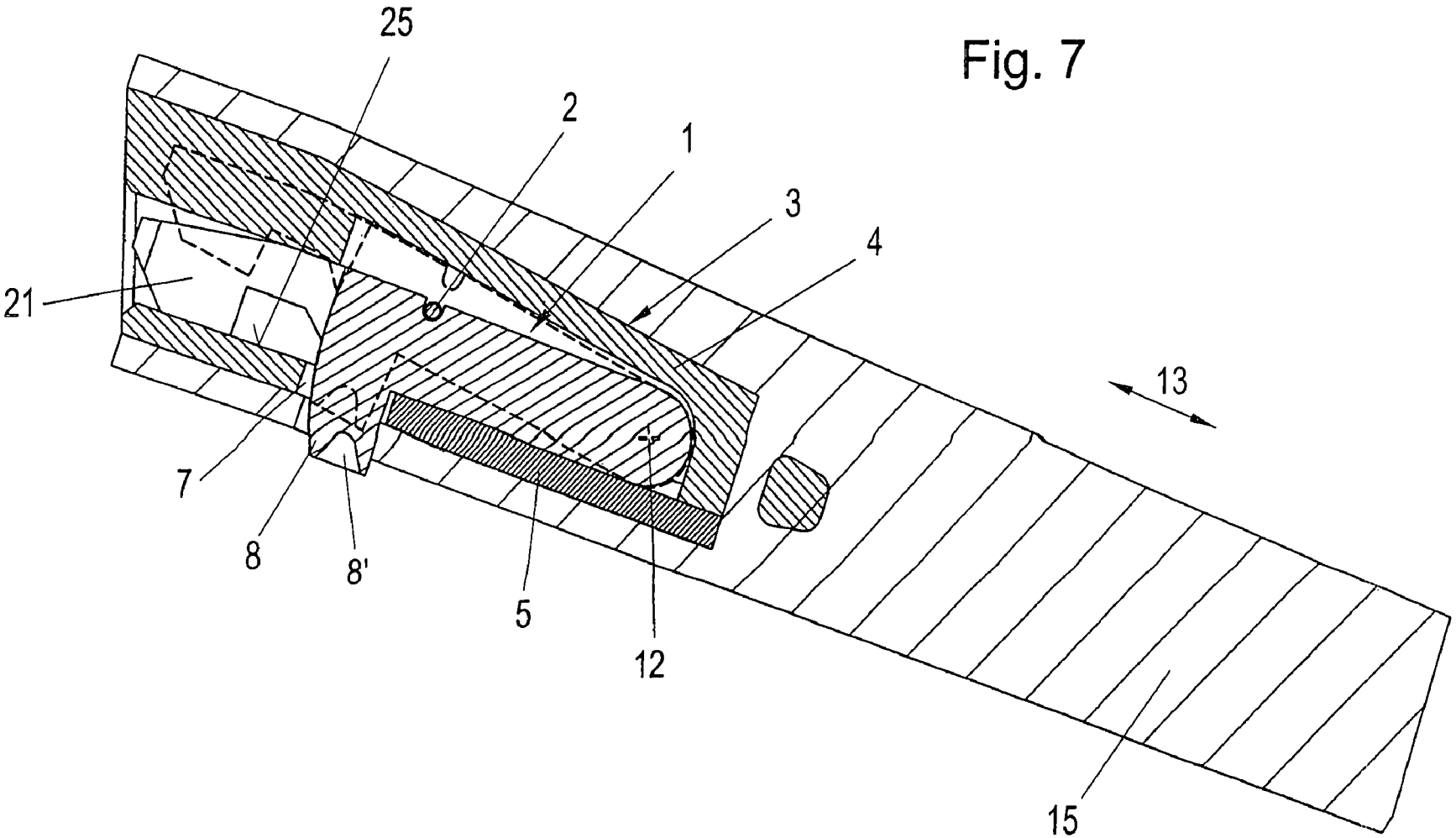
FIG. 7 is a section through a wristband, with the cutting plane lying in parallel to the longitudinal axis of the wristband and vertically to the plane formed by the wristband.

The exploded view according to FIG. 1 illustrates a locking element 1 preferably manufactured from metal and provided with a spring element 2, which is illustrated alone and separately in FIG. 4. As can also be seen in FIG. 2, the locking element 1 is provided in a casing 3 preferably manufactured from metal but otherwise from a synthetic material for relatively narrow and thin bands, which casing is formed by two parts 4, 5, wherein the two casing parts 4, 5 are connected to each other by means of a snap connection 6 after the locking element 1 has been inserted into the casing part 4.

The casing 3 forms part of a watchband 15 and is firmly, i.e., fixedly, connected to the same, for example, by gluing, welding or integral casting, in particular integral moulding.

The casing 3 exhibits a recess 7 through which an actuating part 8 for the locking element 1 projects outward. An actuating notch 8' is provided at the end of the actuating part 8 which is oriented outward. On its front side, the casing 3 has an opening 9 into which a retaining clip 10 of a watch casing 11 is insertable. The retaining clips 10 are preferably formed integral with the watch casing 11.

The locking element 1 is pivotable in the casing 3, as can be seen in particular in FIG. 7, into a position releasing the retaining clip 10—as illustrated with broken lines—as well as into a position fastening the retaining clip 10—as illustrated with solid lines—, namely about an axis 12 oriented transversely to the longitudinal direction 13 and in parallel to the band plane 14 of a band 15, in particular of a watchband. Said axis 12 is formed by two axle stubs arranged at the locking element 1, which are insertable into corresponding recesses 17 of the casing 3. The spring element 2 pushes the locking element 1 into the retaining position by means of a clamp 18 bridging over the locking element 1. The free ends 19 of the spring element 2 rest against the casing part 4 at the inside thereof.

The retaining clips 10 are penetrated by two adjacent recesses 20 into which the hooks 21 of the locking element 1 are insertable if the retaining clips 10 are inserted into the casing 3 through the opening 9. In this way, a form-fitting connection is provided between the retaining clip 10 and the locking element 1, whereby the hooks 21 are pushed against the back wall 25 of the casing part 4 by means of the spring element 2 and the form-fitting connection is prevented from opening unintentionally.

Figure 8:
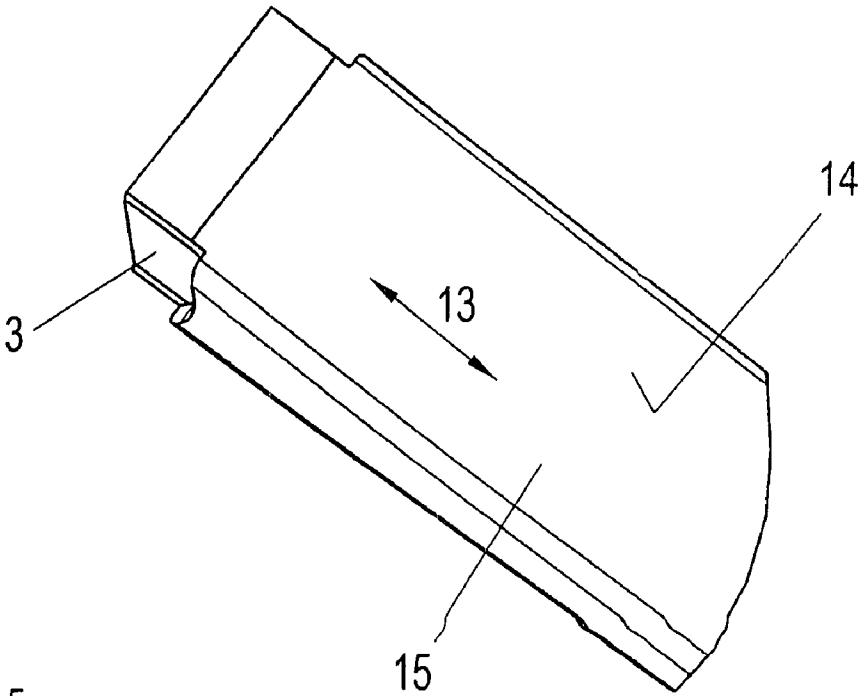
FIGS. 8 and 9 show the wristband seen from above and from below.
Figure 9:
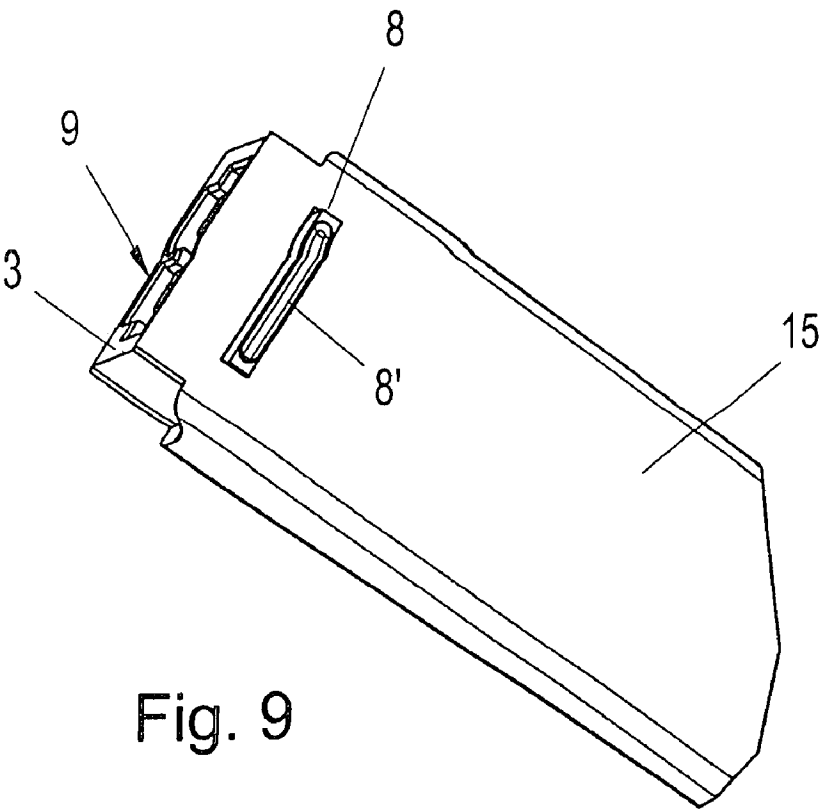
Figure 10:
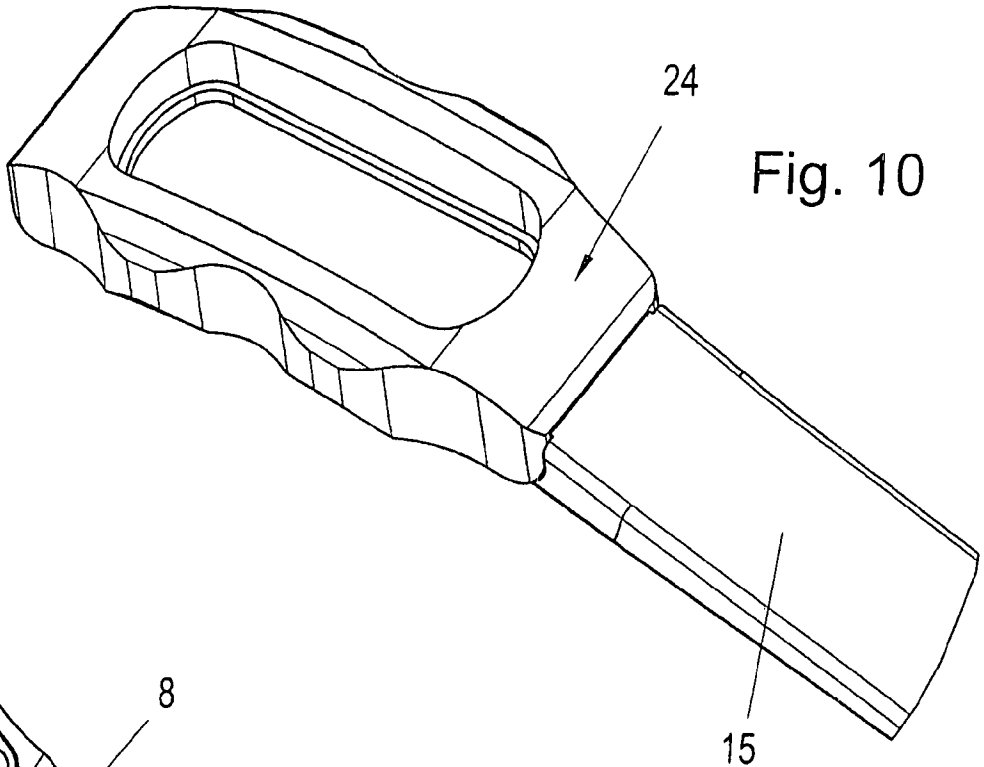
FIGS. 10 and 11 show a wristband attached to a watch casing, seen from above and from below, in each case in diagonal section.
Figure 11:
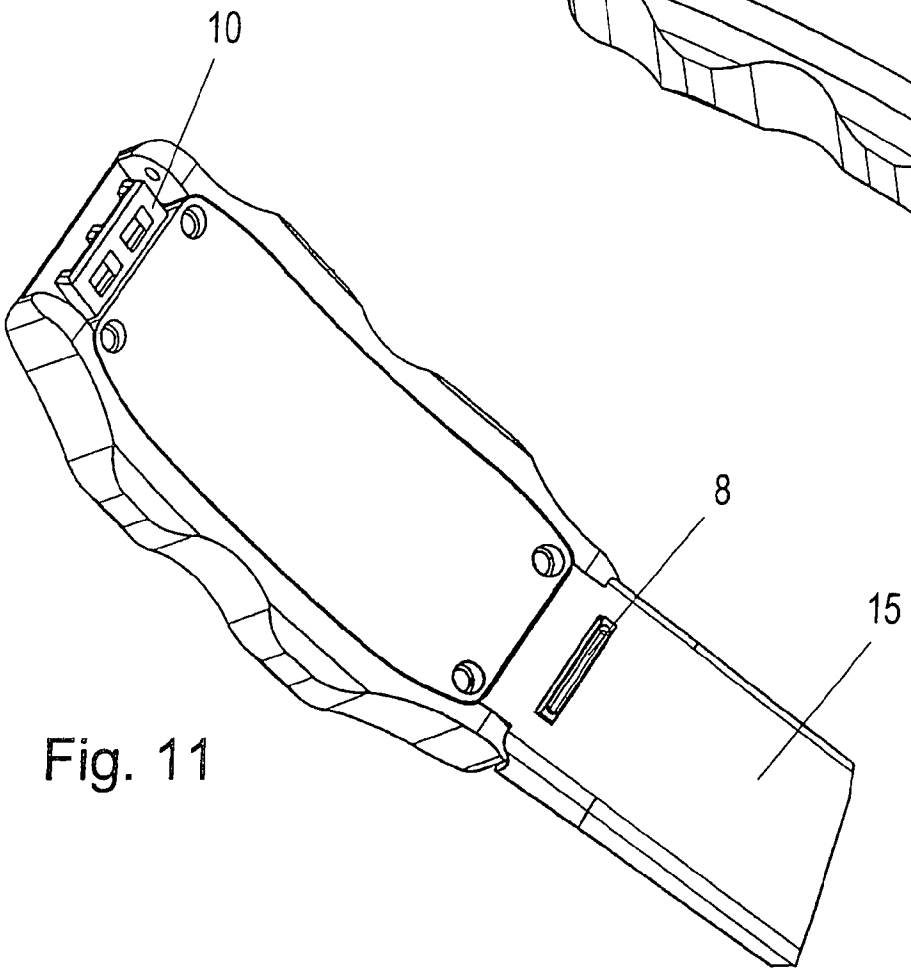

As can be seen in FIGS. 8 and 9, according to the embodiment illustrated therein, the watch casing 11 is provided with a cover 24 covering the retaining clips 10 toward the top side 22 of the watch casing 11 and toward the side faces 23 thereof.

The invention is not limited to the exemplary embodiment illustrated in the drawing but also comprises variants. The invention can be used for connecting any bands 15 to any parts 11, e.g., also pieces of jewelery. Furthermore, the term "band" also comprises band-like formations made up of link bodies.

The invention claimed is:

1. A device for the connection of a band (15) to a further part (11), characterized by a combination of the following features:

a casing (3) fixed to the band (15), forming a unit with the band (15) and receiving a locking element (1), wherein the locking element (1) in the casing (3) is mounted about an axis (12) so as to be pivotable from a retaining position into a release position and back, the axis (12) is oriented transversely to the longitudinal extension (13) of the band (15) and in parallel to a plane (14) of the band, the casing (3) is provided, at the front side, with an opening (9) for inserting a retaining clip (10) arranged at the further part (11), such that the retaining clip (10) can be brought into a form-fitting connection with the locking element (1) which is in the retaining position, and wherein the locking element (1) ends in the region of the front side of the casing (3) without projecting from the casing (3) both in the retaining position and in the release position.

2. A device according to claim 1, characterized by a spring element (2) pushing the locking element (1) into the retaining position.

3. A device according to claim 1, characterized in that the form-fitting connection between the locking element (1) and the retaining clip (10) is substantially free from play.

4. A device according to claim 1, characterized in that the casing (3) is glued to a wristband (15), in particular to a watchband (15), or is cast integral with the same.

5. A device for the connection of a band (15) to a further part (11), characterized by a combination of the following features:

a casing (3) fixed to the band (15), forming a unit with the band (15) and receiving a locking element (1), wherein the locking element (1) in the casing (3) is mounted about an axis (12) so as to be pivotable from a retaining position into a release position and back, the axis (12) is oriented transversely to the longitudinal extension (13) of the band (15) and in parallel to a plane (14) of the band, the casing (3) is provided, at the front side, with an opening (9) for inserting a retaining clip (10) arranged at the further part (11), such that the retaining clip (10) can be brought into a form-fitting connection with the locking element (1) which is in the retaining position, the locking element (1) is provided with an actuating part (8) projecting through an opening (7) disposed on one side of the casing (3), optionally projecting beyond the exterior thereof, and wherein the actuating part (8) is provided with an actuating notch (8') at its end projecting through the opening (7) of the casing (3).

6. A device for the connection of a band (15) to a further part (11), characterized by a combination of the following features:

a casing (3) fixed to the band (15), forming a unit with the band (15) and receiving a locking element (1), wherein the locking element (1) in the casing (3) is mounted about an axis (12) 50 as to be pivotable from a retaining position into a release position and back, the axis (12) is oriented transversely to the longitudinal extension (13) of the band (15) and in parallel to a plane (14) of the band, the casing (3) is provided, at the front side, with an opening (9) for inserting a retaining clip (10) arranged at the further part (11), such that the retaining clip (10) can be brought into a form-fitting connection with the locking element(1) which is in the retaining position, the casing (3) has a two-part design, and wherein the two casing parts (4, 5) can be fixed to each other by means of a snap connection (6).

7. A device, comprising:

a band (15);

a further part (11) for connection to the band (15); and a connecting part for connecting the band (15) and the further part (11), the connecting part comprising a casing (3) fixed to the band (15), the casing receiving a locking element (1), wherein the locking element (1) in the casing (3) is mounted about an axis (12) so as to be pivotable from a retaining position into a release position and back, the axis (12) is oriented transversely to the longitudinal extension (13) of the band (15) and in parallel to a plane (14) of the band, the casing (3) is provided, at the front side, with an opening (9) for inserting a retaining clip (10) arranged at a further part (11), such that the retaining clip (10) can be brought into a form-fitting connection with the locking element (1) which is in the retaining position, and wherein the retaining clip (10) of the further part (11) is rigidly arranged on the further part.

8. A device for the connection of a band (15) to a further part (11), characterized by a combination of the following features:

a casing (3) fixed to the band (15), forming a unit with the band (15) and receiving a locking element (1), wherein the locking element (1) in the casing (3) is mounted about an axis (12) so as to be pivotable from a retaining position into a release position and back, the axis (12) is oriented transversely to the longitudinal extension (13) of the band (15) and in parallel to a plane (14) of the band, the casing (3) is provided, at the front side, with an opening (9) for inserting a retaining clip (10) arranged at the further part (11), such that the retaining clip (10) can be brought into a form-fitting connection with the locking element (1) which is in the retaining position, and wherein the locking element (1) is provided with two hooks (21) arranged side by side which are insertable into corresponding shaped recesses (20) of the retaining clip (10).

9. A device, comprising:

a band (15);

a further part (11) for connection to the band (15); and a connecting part for connecting the band (15) and the further part (11), the connecting part comprising a casing (3) fixed to the band (15), the casing receiving a locking element (1), wherein the locking element (1) in the casing (3) is mounted about an axis (12) so as to be pivotable from a retaining position into a release position and back, the axis (12) is oriented transversely to the longitudinal extension (13) of the band (15) and in parallel to a plane (14) of the band, the casing (3) is provided, at the front side, with an opening (9) for inserting a retaining clip (10) arranged at a further part (11), such that the retaining clip (10) can be brought into a form-fitting connection with the locking element (1) which is in the retaining position, and wherein the further part is designed as a watch casing (11) and the retaining clip (10) is formed integral with the watch casing (11) and, with the watchband (15) being attached, is covered by the same or by the casing (3), respectively, preferably toward the top side (22) and toward the side faces (23) of the watch casing.

10. A device, comprising:

a band (15);

a further part (11) for connection to the band (15); and a connecting part for connecting the band (15) and the further part (11), the connecting part comprising a casing (3) fixed to the band (15), the casing receiving a locking element (1), wherein the locking element (1) in the casing (3) is mounted about an axis (12) so as to be pivotable from a retaining position into a release position and back, the axis (12) is oriented transversely to the longitudinal extension (13) of the band (15) and in parallel to a plane (14) of the band, the casing (3) is provided, at the front side, with an opening (9) for inserting a retaining clip (10) arranged at the further part (11), such that the retaining clip (10) can be brought into a form-fitting connection with the locking element (1) which is in the retaining position, and wherein the further part (11) comprises a watch casing.

11. A device according to claim 10, wherein the band (15) comprises a wristband.

12. A device according to claim 10, wherein the band (15) comprises a watchband.

* * * * *